US011844445B2

(12) United States Patent
Nilsson

(10) Patent No.: US 11,844,445 B2
(45) Date of Patent: Dec. 19, 2023

(54) SHELF ELEMENT FOR A SHELF SYSTEM OF A RACK, EXTRUDED PROFILE, SHELF FRAME, SHELF SYSTEM AND RACK

(71) Applicant: Rickard Nilsson, Balduinstein (DE)

(72) Inventor: Rickard Nilsson, Balduinstein (DE)

( * ) Notice: Subject to any disclaimer, the term of this patent is extended or adjusted under 35 U.S.C. 154(b) by 326 days.

(21) Appl. No.: 17/256,239

(22) PCT Filed: May 31, 2019

(86) PCT No.: PCT/DE2019/100482

§ 371 (c)(1),
(2) Date: Apr. 21, 2021

(87) PCT Pub. No.: WO2020/001680

PCT Pub. Date: Jan. 2, 2020

(65) Prior Publication Data

US 2023/0055696 A1 Feb. 23, 2023

(30) Foreign Application Priority Data

Jun. 28, 2018 (DE) ..... 10 2018 115 667.7

(51) Int. Cl.
*A47F 5/00* (2006.01)
*G09F 3/20* (2006.01)

(52) U.S. Cl.
CPC ..... *A47F 5/0043* (2013.01); *G09F 3/204* (2013.01)

(58) Field of Classification Search
CPC ..... A47F 5/0043; G09F 3/204
See application file for complete search history.

(56) References Cited

U.S. PATENT DOCUMENTS

| | | | | |
|---|---|---|---|---|
| 10,164,388 | B2 * | 12/2018 | Kokenda | H02G 5/002 |
| 10,271,452 | B2 * | 4/2019 | Hennrich | E05C 9/041 |
| 2018/0180261 | A1 * | 6/2018 | Xue | A47F 5/0043 |
| 2018/0182267 | A1 * | 6/2018 | Zeng | F21S 4/28 |
| 2019/0231068 | A1 * | 8/2019 | Breslow | H01R 25/147 |

FOREIGN PATENT DOCUMENTS

| | | | | |
|---|---|---|---|---|
| DE | 10148695 | A1 * | 3/2003 | A47B 57/588 |
| DE | 102010038968 | A1 | 12/2011 | |
| EP | 1559345 | A1 | 8/2005 | |
| EP | 2324732 | A1 | 5/2011 | |
| WO | 03034875 | A1 | 5/2003 | |
| WO | 2016008476 | A1 | 1/2016 | |

* cited by examiner

*Primary Examiner* — Ko H Chan
(74) *Attorney, Agent, or Firm* — Smartpat PLC

(57) ABSTRACT

A shelf element comprises an upper side, a lower side and an elongated main body. The main body has two limb portions and an intermediate portion located therebetween. The intermediate portion is assigned to the upper side of the shelf element. The main body also has at least one through-passage opening that passes transversely through at least one of the limb portions and/or the intermediate portion. At least one coupling location is provided in each of the longitudinal-side ends of the shelf element, to couple an add-on part and/or a shelf component and/or a rack component. At least one rib is provided, which is assigned to the intermediate portion and has a longitudinal extent in the longitudinal direction of the main body. A separate reinforcing element may be assigned to the main body, in order to reinforce the main body against forces acting transversely with respect to its longitudinal extent.

16 Claims, 4 Drawing Sheets

SHELF ELEMENT FOR A SHELF SYSTEM OF A RACK, EXTRUDED PROFILE, SHELF FRAME, SHELF SYSTEM AND RACK

U.S. patent publication US 2023/0055,696 of the present application fails to reflect the preliminary amendment filed 28 Dec. 2020. The Applicant resubmits the substitute specification to ensure that it appears with the most recent date in the image file wrapper in hopes to so prevent a future erroneous patent publication.

TECHNICAL FIELD

The disclosure relates to a shelf element for a shelf system of a rack. The disclosure further relates to an extruded profile for manufacturing a shelf element. In addition, the disclosure relates to a shelf frame, a shelf system and a rack.

BACKGROUND

A shelf element for a shelf system of a rack is known from WO 2016/008476 A1. The shelf element is used there, for example, as a longitudinal-side frame part of a shelf frame that, together with an opposite frame part and two side parts, forms the shelf frame of a shelf system.

SUMMARY

It is an object of the disclosure to propose at least one possibility of further developing a shelf element of the type mentioned above. Furthermore, a shelf frame, a shelf system and a rack that are suitable for the use of such a further developed shelf element shall be proposed. This object is achieved by the invention as claimed.

A basic shelf element, for example for a shelf or shelf unit of a rack, comprises an upper side, an underside opposite to the upper side, and an elongated main body. Preferably, the main body, as seen in cross-section, has two limb portions and an intermediate portion therebetween, which is assigned, for example, to the upper side of the shelf element. The limb portions and the intermediate portion can be components of an open hollow cross-section of the main body. Alternatively, the limb portions and the intermediate portion can be components of a closed hollow cross-section of the main body. For example, the intermediate portion is formed to support or place thereon a base element serving to support merchandise.

In the case of the shelf element, it is provided in particular that the main body has at least one through-passage opening that passes through at least one of the limb portions and/or the intermediate portion transversely with respect to the longitudinal extent of the main body. The at least one through-passage opening can be formed to be slot-shaped. It is to be understood by this in particular that the at least one through-passage opening is formed to be elongated and narrow. For example, the slot-shaped through-passage opening extends with its longitudinal extent transversely with respect to the longitudinal extent of the main body. In particular, the at least one through-passage opening is formed to be used as an insertion opening for an add-on part and/or built-in part, for example in order to insert a merchandise separator with an insertion portion therein.

A plurality of such through-passage openings can also be provided. For example, the through-passage openings are arranged one behind the other in the direction of the longitudinal extent of the main body. To the extent that each of the through-passage openings is formed to be slot-shaped, each of the through-passage openings runs with its longitudinal extent transversely with respect to the longitudinal extent of the main body.

In particular, the shelf element is provided with at least one coupling location in the area of each of its longitudinal-side ends. Preferably, the at least one coupling location is configured to couple, in particular to attach, an add-on part and/or a shelf component and/or a rack component.

For example, at least one functional element may be provided that performs a reinforcing function with respect to the shelf element. According to one embodiment, the shelf element has at least one rib, in particular an elongated rib, for this purpose. In particular, the at least one rib is assigned to the intermediate portion. Preferably, the at least one rib has a longitudinal extent in the longitudinal direction of the main body, that is in the direction of the longitudinal extent of the main body. For example, the at least one rib extends continuously with its longitudinal extent in the longitudinal direction of the main body.

In doing so, a measure is taken to improve the rigidity of the shelf element and thus make the shelf element more robust against acting forces. By the at least one rib extending with its longitudinal extent in the longitudinal direction of the main body, a measure is taken to reinforce the shelf element, in particular the main body, against forces acting transversely with respect to its longitudinal extent and to counteract any bending deformation. The measure of associating the at least one rib with the intermediate portion of the main body is also aimed at this, for example in that the at least one rib is arranged or formed on the intermediate portion, in particular is integrally formed, and projects away from the intermediate portion, for example.

To the extent that the at least one through-passage opening passes through the intermediate portion, there should be a surface portion usable as an abutment between the at least one through-passage opening and the rib. This makes it possible for an insertion portion of an add-on part and/or built-in part, such as a merchandise separator, inserted into the at least one through-passage opening to be brought into a securing position, in which the insertion portion is secured against being pulled out of the at least one through-passage opening. The surface portion, which serves as an abutment for the insertion portion in the securing position, can be used for this purpose.

With an additional embodiment, the at least one rib forms a wall portion of a, preferably elongated, chamber structure that extends in the longitudinal direction of the main body, in particular with its longitudinal extent extending in the longitudinal direction of the main body. This is also intended to reinforce the shelf element in order to make it more robust against any forces that can occur during use, such as transverse forces. The chamber structure helps to form a reinforcing structure on the main body, which gives the shelf element improved rigidity to counteract any load-induced deformations. The measure that the chamber structure should comprise one of the limb portions of the main body as a wall portion also aims in this direction.

The chamber structure can be configured to serve as a receptacle for a separate, for example elongated, reinforcing element. This creates a prerequisite for a more extensive reinforcing effect to be exerted by an additional, separate functional part, in that the chamber structure is formed to receive such a functional part. In particular, the chamber structure has an insertion opening that is arranged in such a manner that insertion of the reinforcing element is possible in the longitudinal direction of the main body, that is, the direction for insertion for the reinforcing element is in the longitudinal direction of the main body.

The chamber structure can be formed to be open in cross-section. Alternatively, the chamber structure can be formed to be closed in cross-section. For example, the chamber structure has an angular, in particular polygonal, cross-section. For example, the chamber structure has a square and/or rectangular cross-section. Alternatively, the chamber structure can have a round, in particular circular, cross-section.

With an additional embodiment, the shelf element comprises an insertion receptacle for receiving an insertion part, such as an information carrier and/or a merchandise stopper. This creates the prerequisite for the shelf element to have additional functions, which are performed by the insertion part. For example, the insertion part performs a function as an information carrier. The insertion part can be formed as a price tag for this purpose. In addition or alternatively, the insertion part can perform a function as a merchandise stopper. Such function is useful if the shelf element is a front component of a shelf frame that is arranged at an angle in a rack, such that the front side of the shelf frame is lower than its rear side. In the case of a shelf system formed therefrom, a subsequent sliding of merchandise placed on a shelf surface is intended if merchandise lying in front is removed. A stop is formed by the shelf element with a merchandise stopper accommodated in the insertion receptacle, in order to stop the sliding movement of the merchandise that is sliding.

For example, the insertion receptacle is open towards the upper side of the shelf element, in order to insert the insertion part into the insertion receptacle via the upper side, thus, there is a direction for insertion transverse to the upper side. For this purpose, the insertion receptacle has a corresponding insertion opening that, for example, has an opening surface that is at least partially turned towards the upper side.

It can be provided that, as seen transversely with respect to the direction of insertion, the insertion receptacle is formed to be elongated, in order to receive an insertion strip, such as, for example, a strip-shaped price tag and/or a strip-shaped merchandise stopper. For example, the insertion receptacle is arranged relative to the main body such that the insertion receptacle extends with its longitudinal extent in the longitudinal direction of the main body.

According to one configuration, the insertion receptacle comprises at least two wall portions, one wall portion of which is formed by the main body and the other wall portion of which is formed by a material portion that is bonded, in particular integrally formed, to the main body. For example, a wall portion of the insertion receptacle, in particular one of the at least two wall portions, is formed by one of the limb portions of the main body.

One of the limb portions of the main body, in particular the one limb portion, can additionally form a wall portion of the chamber structure. Thus, the one of the limb portions is used both as a wall portion for the insertion receptacle and as a wall portion for the chamber structure. This is aimed at creating the most stable and robust structure possible for the shelf element with the simplest possible cross-sectional geometry.

Moreover, it can be provided to arrange the limb portions and the intermediate portion relative to each other such that the main body has a U-shaped cross-section that is open in the direction of the underside of the shelf element, that is, open at the bottom. The area between the two limb portions and the intermediate portion can thus be used as a receiving space or a receiving channel for add-on parts, built-in parts, or other parts, for example of the rack. For example, electrical supply lines for lighting or other electrical consumers can be accommodated therein. As the U-shaped cross-section is open at the bottom, it can be accessed and reached from the outside when the shelf element is installed in a shelf frame.

One possible embodiment is that, with respect to the cross-section of the shelf element, the main body and the insertion receptacle each have a U-shaped wall structure with a common limb portion, wherein the U-shaped wall structure of the insertion receptacle is open at the top and the U-shaped wall structure of the main body is open at the bottom, and the common limb portion is used to form the chamber structure comprising the rib. This makes it possible to combine the advantages described above. On the one hand, it is advantageous to provide a stable and robust structure for the shelf element due to the common limb portion, wherein the shelf element has the specified insertion receptacle for a merchandise stopper and/or a price tag and/or other insertion part. On the other hand, the specified receiving space or receiving channel for add-on parts, built-in parts, or other parts, for example of the rack, is created.

An additional possible embodiment is that, with respect to the cross-section of the main body, the at least one coupling location is arranged in the area of one of the limb portions. In particular, it is provided that, with respect to the cross-section of the main body, the at least one coupling location is arranged in the area of an end of one of the limb portions, for example in the area of an end of one of the limb portions turned away from the intermediate portion.

In addition or alternatively, with respect to the cross-section of the shelf element, the at least one coupling location can be provided in the area of a wall of the insertion receptacle and/or in the area of a wall of the chamber structure and/or in the area of a transition from the main body to the one material portion at least partially forming the insertion receptacle and/or in the area of a transition from the chamber structure to the insertion receptacle. For example, the at least one coupling location is arranged in the area of a free end of the one limb portion and/or in the area of a bottom of the insertion receptacle. For example, the at least one coupling location is provided in the area of the common limb portion.

This counteracts any yielding of the walls of the insertion receptacle if, for example, a force is applied to an insertion part located in the insertion receptacle, such as a merchandise stopper. Such force can, for example, come from merchandise sliding down if the shelf element forms a front component of a shelf frame that is installed in a rack system inclined downwards towards its front side.

With an additional embodiment, the main body has at least one additional coupling location in the area of each of its longitudinal-side ends, which is configured to couple an add-on part, a shelf component and/or a rack component thereto. For example, the at least one coupling location is provided in the area of one limb portion and the at least one additional coupling location is provided in the area of the other limb portion of the main body. In particular, the at least one coupling location and/or the at least one additional coupling location is arranged on the associated limb portion in the area of its free end, that is, the end that is turned away from the intermediate portion, in particular is not adjacent to the intermediate portion.

By providing at least the two coupling locations on at least one of the longitudinal-side ends of the main body and in particular being spaced apart relative to each other, for example being spaced apart relative to each other in the arrangement described above, the shelf element is secured against rotational movement about its longitudinal axis. Such a situation can occur, for example, if there is a transverse force acting with respect to the longitudinal axis via an insertion part located in the insertion receptacle, such as a merchandise stopper. Such transverse force can be generated by merchandise sliding down if the shelf element forms a front component of a shelf frame that is installed in a rack system inclined downwards towards its front side.

It can be provided that the at least one coupling location comprises or is formed from a projection extending longitudinally in the longitudinal direction of the main body. Alternatively, the at least one coupling location can comprise or be formed from a recess extending longitudinally in the longitudinal direction of the main body. For example, the recess is configured for a fastening receptacle of a connecting element for connecting an add-on part and/or a shelf component and/or a rack component. For example, the recess is a component of a cavity of the main body extending in the longitudinal direction of the main body, in particular a continuous cavity of the main body. For example, the projection is formed for fastening insertion into a receptacle for connecting an add-on part and/or a shelf component and/or a rack component.

The shelf element can be a metal part, for example made of metallic material or comprising metallic material, wherein the material or shelf element is, for example, corrosion-resistant or at least low-corrosion. For example, the shelf element is an aluminum part comprising or consisting of, for example, aluminum or an aluminum alloy. In principle, the shelf element can also be a plastic part that, for example, comprises or consists of a dimensionally stable plastic and/or an extrudable plastic. Preferably, the shelf element is made of an extruded profile. This favors a cost-effective production of the shelf element.

As stated above, at least one functional element may be provided that performs a reinforcing function with respect to the shelf element. According to one embodiment, a separate reinforcing element can be assigned to the main body for this purpose. Thereby, another measure is taken to improve the rigidity of the shelf element and thus make the shelf element more robust against forces acting on it.

In particular, the reinforcing element is formed to reinforce the main body against forces acting transversely with respect to its longitudinal extent. For example, the reinforcing element is formed to be elongated and is held in particular on the main body. For example, the reinforcement element extends with its longitudinal extent in the longitudinal direction of the main body. In doing so, measures are taken to counteract any bending deformation of the main body or shelf element, as the case may be.

The reinforcing element can be a metal profile. For example, the reinforcing element is a steel profile or stainless steel profile. To protect against corrosion, the reinforcing element can be provided with a corrosion-inhibiting coating. For example, the cross-section of the reinforcing element is constant or essentially constant in the direction of its longitudinal extent. For example, the reinforcing element has an angular, in particular polygonal, cross-section. For example, the reinforcing element has a square and/or rectangular cross-section. Alternatively, the reinforcing element can have a round, in particular circular, cross-section.

With one embodiment, the shelf element is provided with the chamber structure described above and the reinforcing element is received in the chamber structure, in particular held therein. For example, the reinforcing element extends with its longitudinal extent in the chamber structure in the direction of its longitudinal extent. By means of the chamber structure and the separate reinforcing element, both measures described above are implemented in the shelf element in order to improve the rigidity of the shelf element.

One aspect of the disclosure relates to an extruded profile for producing at least one embodiment and/or configuration of the shelf element described above. The extruded profile can be a metal part, such as an aluminum part. Moreover, the extruded profile can be a plastic part.

The extruded profile comprises an upper side, an underside opposite to the upper side, and an elongated main body. Preferably, the main body, as seen in cross-section, has two limb portions and an intermediate portion therebetween, which is assigned, for example, to the upper side of the extruded profile. The limb portions and the intermediate portion can be components of an open hollow cross-section of the main body. Alternatively, the limb portions and the intermediate portion can be components of a closed hollow cross-section of the main body. For example, the intermediate portion is formed to support or place thereon a base element serving to support merchandise.

In particular, the extruded profile is provided with at least one coupling location in the area of each of its longitudinal-side ends. Preferably, the at least one coupling location is configured to couple, in particular to attach, an add-on part and/or a shelf component and/or a rack component.

According to one embodiment, the extruded profile comprises at least one rib, in particular an elongated rib. In particular, the at least one rib is assigned to the intermediate portion. Preferably, the at least one rib has a longitudinal extent in the longitudinal direction of the main body, that is in the direction of the longitudinal extent of the main body. For example, the at least one rib extends continuously with its longitudinal extent in the longitudinal direction of the main body.

According to an additional embodiment, the at least one rib forms a wall portion of a, preferably elongated, chamber structure that extends in the longitudinal direction of the main body, in particular with its longitudinal extent extending in the longitudinal direction of the main body. For example, the chamber structure comprises one of the limb portions of the main body as a wall portion.

The chamber structure can be configured to serve as a receptacle for a separate, for example elongated, reinforcing element. In particular, the chamber structure has an insertion opening that is arranged in such a manner that insertion of the reinforcing element is possible in the longitudinal direction of the main body, that is, the direction for insertion for the reinforcing element is in the longitudinal direction of the main body.

The chamber structure can be formed to be open in cross-section. Alternatively, the chamber structure can be formed to be closed in cross-section. For example, the chamber structure has an angular, in particular polygonal, cross-section. For example, the chamber structure has a square and/or rectangular cross-section. Alternatively, the chamber structure can have a round, in particular circular, cross-section.

With an additional embodiment, the extruded profile comprises an insertion receptacle for receiving an insertion part, such as an information carrier and/or a merchandise stopper. For example, the insertion receptacle is open towards the upper side of the extruded profile, in order to insert the insertion part into the insertion receptacle via the upper side, thus, there is a direction for insertion transverse to the upper side. For this purpose, the insertion receptacle has a corresponding insertion opening that, for example, has an opening surface that is at least partially turned towards the upper side.

It can be provided that, as seen transversely with respect to the direction of insertion, the insertion receptacle is formed to be elongated, in order to receive an insertion strip, such as, for example, a strip-shaped price tag and/or a strip-shaped merchandise stopper. For example, the insertion receptacle is arranged relative to the main body such that the insertion receptacle extends with its longitudinal extent in the longitudinal direction of the main body.

According to one configuration, the insertion receptacle comprises at least two wall portions, one wall portion of which is formed by the main body and the other wall portion of which is formed by a material portion that is bonded, in particular integrally formed, to the main body. For example, a wall portion of the insertion receptacle, in particular one of the at least two wall portions, is formed by one of the limb portions of the main body.

One of the limb portions of the main body, in particular the one limb portion, can additionally form a wall portion of the chamber structure. Thus, the one of the limb portions is used both as a wall portion for the insertion receptacle and as a wall portion for the chamber structure. Moreover, it can be provided to arrange the limb portions and the intermediate portion relative to each other such that the main body has a U-shaped cross-section that is open in the direction of the underside of the extruded profile, that is, open at the bottom.

One possible embodiment is that, with respect to the cross-section of the extruded profile, the main body and the insertion receptacle each have a U-shaped wall structure with a common limb portion, wherein the U-shaped wall structure of the insertion receptacle is open at the top and the U-shaped wall structure of the main body is open at the bottom, and the common limb portion is used to form the chamber structure comprising the rib.

An additional possible embodiment is that, with respect to the cross-section of the main body, the at least one coupling location is arranged in the area of one of the limb portions. In particular, it is provided that, with respect to the cross-section of the main body, the at least one coupling location is arranged in the area of an end of one of the limb portions, for example in the area of an end of one of the limb portions turned away from the intermediate portion.

In addition or alternatively, with respect to the cross-section of the extruded profile, the at least one coupling location can be provided in the area of a wall of the insertion receptacle and/or in the area of a wall of the chamber structure and/or in the area of a transition from the main body to the one material portion at least partially forming the insertion receptacle and/or in the area of a transition from the chamber structure to the insertion receptacle. For example, the at least one coupling location is arranged in the area of a free end of the one limb portion and/or in the area of a bottom of the insertion receptacle. For example, the at least one coupling location is arranged in the area of a free end of the one limb portion and/or in the area of a bottom of the insertion receptacle.

With an additional embodiment, the main body has at least one additional coupling location in the area of each of its longitudinal-side ends, which is configured to couple an add-on part, a shelf component and/or a rack component to it. For example, the at least one coupling location is provided in the area of one limb portion and the at least one additional coupling location is provided in the area of the other limb portion of the main body. In particular, the at least one coupling location and/or the at least one additional coupling location is arranged on the associated limb portion in the area of its free end, that is, the end that is turned away from the intermediate portion, in particular is not adjacent to the intermediate portion.

It can be provided that the at least one coupling location comprises or is formed as a recess extending longitudinally in the longitudinal direction of the main body. For example, the recess is a component of a cavity of the main body extending in the longitudinal direction of the main body, in particular a continuous cavity of the main body.

According to an additional aspect of the disclosure, a shelf frame for a shelf of a rack is provided. The shelf frame comprises at least one embodiment and/or configuration of the shelf element described above, which is used as a frame part for the shelf frame. For example, the shelf element and an opposite shelf element of the same or different type are provided, which are connected to each other by at least two side parts to form a frame or an interior space.

An additional aspect of the disclosure relates to a shelf system for a rack. The shelf system comprises at least one embodiment and/or configuration of the shelf element described above and/or at least one embodiment and/or configuration of the shelf frame described above. Preferably, at least one base element is further provided to support merchandise.

A rack, for example a sliding rack, is also encompassed by the disclosure. The rack comprises at least one shelf element and/or a shelf frame and/or a shelf system, wherein the shelf element can be at least one embodiment and/or configuration of the shelf element described above, the shelf frame can be at least one embodiment and/or configuration of the shelf frame described above and the shelf system can be at least one embodiment and/or configuration of the shelf system described above.

Further details and features will be apparent from the following description of at least one exemplary embodiment on the basis of the drawings.

DETAILED DESCRIPTION

Figure 1:
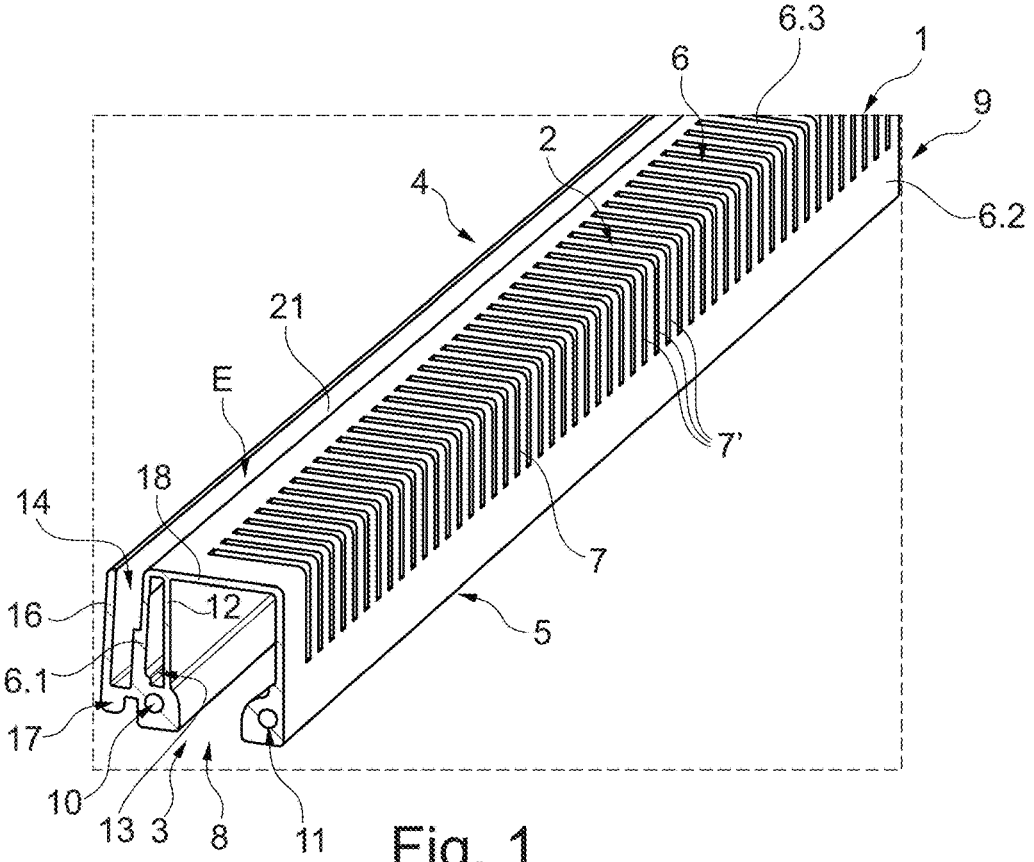
FIG. 1 shows a possible embodiment of a shelf element in perspective view as a cut-out of a front length portion.
Figure 2:
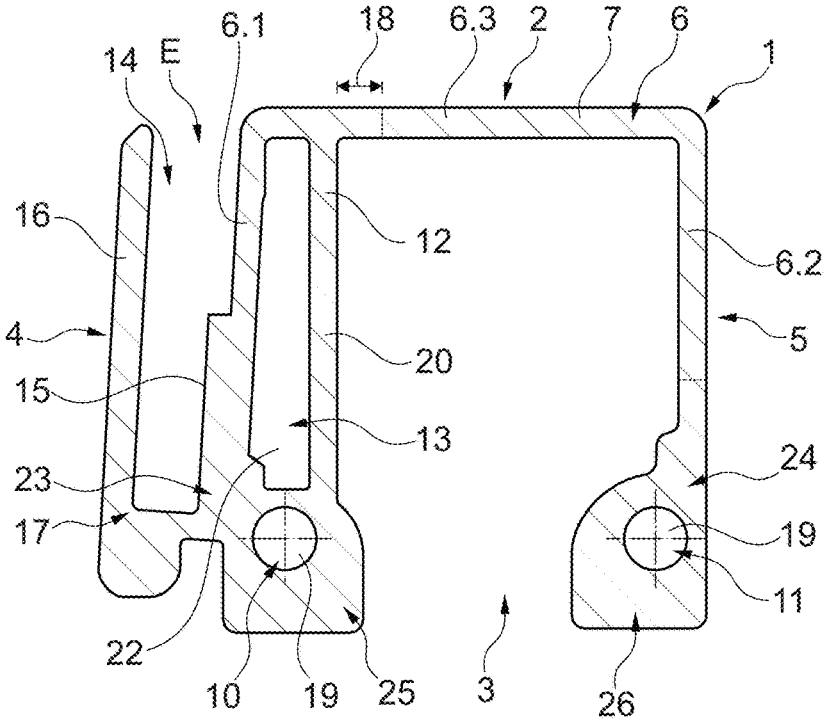
FIG. 2 shows the shelf element of FIG. 1 in a view of a longitudinal-side end.

FIGS. 1 and 2 show—in schematic representation—a possible embodiment of a shelf element 1 for a shelf or a shelf system, for example of a rack. The shelf element 1 is formed to be elongated and, as seen in cross-section, has an upper side 2, an underside 3 opposite the upper side 2, a front side 4 and a rear side 5 opposite the front side 4. The upper side 2 of the shelf element 1 can be used to support one or more deck elements that can be used to support merchandise.

The shelf element 1 is suitable to be used as a frame part for a shelf frame (not shown in FIGS. 1 and 2). For example, the shelf element 1 is to be used as a longitudinal-side frame part of the shelf frame. For example, the shelf element 1, with an opposing frame part and two side parts, forms the shelf frame. A merchandise support (not shown in FIGS. 1 and 2) can be placed on or attached to the shelf frame. For this purpose, the upper side 2 of the shelf element 1 can be used, against which the merchandise support is supported.

The shelf element 1 has an elongated main body 6 that, as seen in cross-section, has two limb portions 6.1, 6.2 and an intermediate portion 6.3 located therebetween. The limb portions 6.1 and 6.2 along with the intermediate portion 6.3 can be components of an open hollow cross-section of the main body 6. For example, the limb portions 6.1, 6.2 and the intermediate portion 6.3 form a U-shaped cross-section of the main body 6. Preferably, the intermediate portion 6.3 is turned towards the upper side 2 of the shelf element 1. Preferably, the limb portion 6.1 is turned towards the front side 4 of the shelf element. Preferably, the limb portion 6.2 is turned towards the rear side 5 of the shelf element 1. Preferably, the main body 6 is open at the bottom, that is, towards the underside 3.

The main body 6 also has at least one through-passage opening 7, which passes through one of the limb portions 6.1, 6.2, in particular the limb portion 6.2, and/or the intermediate portion 6.3 transversely with respect to the longitudinal extent of the main body 6. The at least one through-passage opening 7 can be formed to be slot-shaped. In such a case, their longitudinal extent then runs transversely with respect to the longitudinal extent of the main body 6. The at least one through-passage opening 7 is formed to be used as an insertion opening for an insertion portion of an add-on part and/or built-in part, such as a merchandise separator.

In order to be able to flexibly attach the add-on part or built-in part to various locations of the shelf element 1, a plurality of through-passage openings 7' are preferably provided in the manner of the at least one through-passage opening 7. The through-passage openings 7' are arranged, for example, one behind the other in the direction of the longitudinal extent of the main body 6. To the extent that the through-passage openings 7' are formed to be slot-shaped, each of the through-passage openings 7' extends with its longitudinal extent transversely with respect to the longitudinal extent of the main body 6.

The shelf element 1 preferably has at least one coupling location 10 in the area of each of its longitudinal-side ends 8, 9. The longitudinal-side end 9 is not directly visible in FIG. 1 but is indicated by the reference sign "9." The at least one coupling location 10 is configured to couple thereto an add-on part or a shelf component or a rack component. For example, the side part of the shelf frame described above (not shown in FIGS. 1 and 2) can be coupled thereto.

A rib 12 or rib element or rib section is provided on the shelf element 1. For example, the rib 12 is assigned to the intermediate portion 6.3. For example, the rib 12 is further arranged between the two limb portions 6.1 and 6.2. Preferably, the rib 12 protrudes from the intermediate portion 6.3, in particular protrudes downwards from the intermediate portion 6.3 in the direction of the underside 3. Preferably, the rib 12 is formed on the intermediate portion 6.3, in particular integrally formed thereon. Preferably, the rib 12 is formed to be elongated and has a longitudinal extent in the longitudinal direction of the main body 6.

Preferably, the rib 12 is arranged at the intermediate portion 6.3 in such a manner that, between the at least one through-passage opening 7 and the rib 12, there is a surface portion 18 that can be used as an abutment. For example, this allows an insertion portion, for example of a merchandise separator, to be inserted into the at least one insertion opening 7 and to be brought into a securing position by a movement in the direction of the front side 4 of the shelf element 1, in which insertion portion engages behind the material portion 18 and in this manner a pulling out of the insertion portion from the at least one through-passage opening 7 is prevented.

As shown in FIGS. 1 and 2, the rib 12 can be or form a component of a wall portion 20 of a chamber structure 13, which extends in the longitudinal direction of the main body 6. Preferably, the chamber structure 13 comprises an additional wall portion 15, which is formed by one of the limb portions 6.1, 6.2, in particular the limb portion 6.1. For example, the chamber structure 13 is formed to be closed with respect to the cross-section of the main body 6. By means of the rib 12 and/or the chamber structure 13, a measure is taken to reinforce the shelf element 1, in particular to stiffen it against forces acting transversely with respect to the longitudinal extent of the shelf element 1.

The at least one coupling location 10 can be arranged in the area of an end 23 or 24 of one of the limb portions 6.1, 6.2 turned towards the underside 3. For example, with respect to its cross-section, the main body 6 has, in the area of the end 23 of the limb portion 6.1, a material thickening 25, at which the at least one coupling location 10 is arranged or formed. For example, the at least one coupling location 10 is arranged in the area of a transition from the limb portion 6.1 to the wall portion 20, which are common components of the chamber structure 13.

Preferably, the shelf element 1 has at least one additional coupling location 11 in the area of one of its longitudinal-side ends 8, 9. The at least one additional coupling location 11 is preferably arranged to couple thereto an add-on part or a shelf component and/or a rack component. Preferably, the at least one additional coupling location 11 is arranged in the area of the other limb portion 6.2, for example in the area of its end 24 turned towards the underside 3. In relation to its cross-section, the main body 6 can also—like the limb portion 6.1—have a material bulge or a material thickening 26 in the area of the end 24, at which the at least one additional coupling location 11 is arranged or formed.

Preferably, the at least one coupling location 10 is a recess 19 extending in the longitudinal direction of the main body 6. For example, the recess 19 is a component of a cavity of the main body 6 extending in the longitudinal direction of the main body 6, in particular a continuous cavity of the main body 6. The at least one additional coupling location 11 can be formed in the same manner.

With the case of the shelf element 1, an insertion receptacle 14 can be provided, which can be used to receive an insertion part (not shown in FIGS. 1 and 2) such as a price tag and/or a merchandise stopper. Preferably, the insertion receptacle 14 is open towards the upper side 2 of the shelf element 1, in order to be able to insert the insertion part into the insertion receptacle 14 in accordance with arrow E via the upper side 2. For this purpose, the receptacle 14 has an insertion opening 21, the opening surface of which is at least partially turned towards the upper side 2.

Preferably, the insertion receptacle 14 is formed to be elongated as seen transversely with respect to the direction of insertion in accordance with arrow E. This makes it convenient to accommodate an insertion strip, such as a strip-shaped price tag or a strip-shaped merchandise stopper. Preferably, the insertion receptacle 14 is arranged with respect to the main body 6 in such a manner that the insertion receptacle 14 extends with its longitudinal extent in the longitudinal direction of the main body 6.

For example, the insertion receptacle 14 is formed by at least two wall portions, one wall portion of which is formed by the main body 6 and the other wall portion 16 of which is formed by a material portion 17 that is bonded, in particular integrally formed, to the main body 6. For example, the wall portion of the main body 6 comprises a wall portion of the limb portion 6.1, for example the wall portion 15 already described above, which is also a component of the chamber structure 13.

Figure 3:
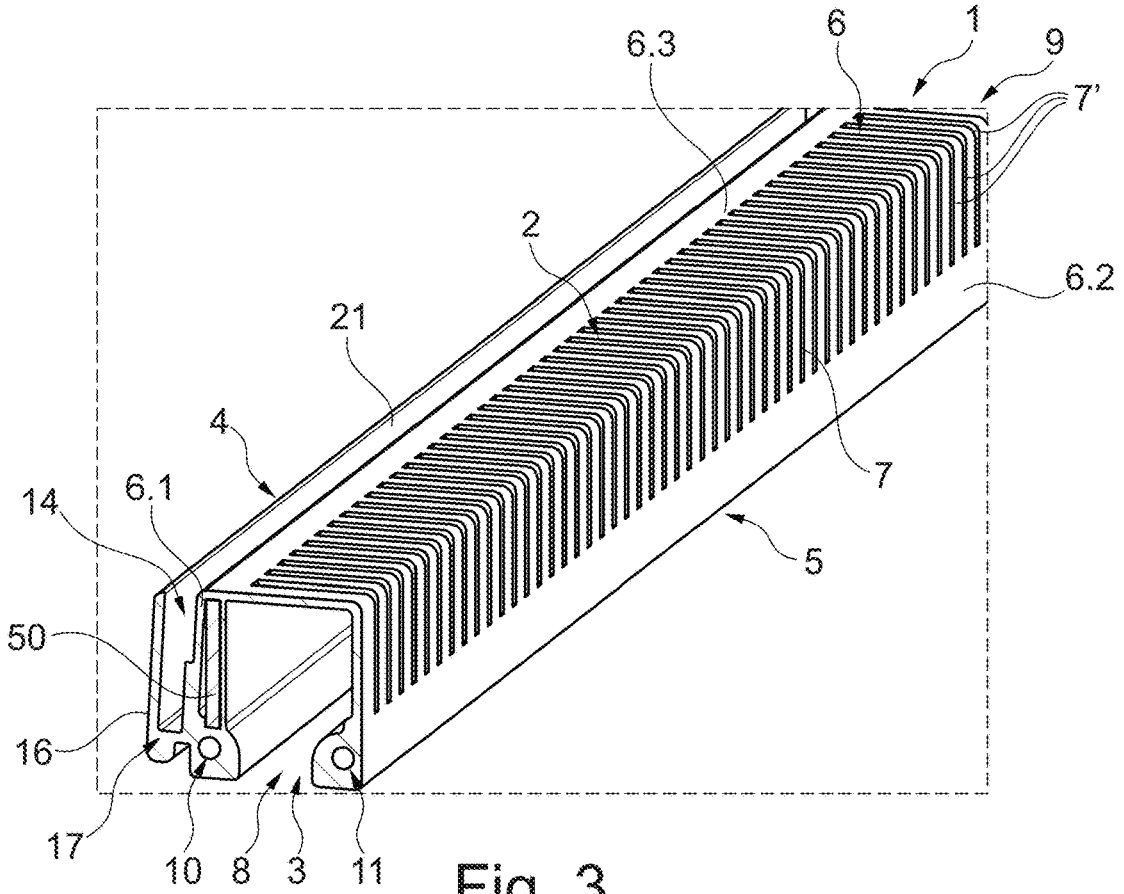
FIG. 3 shows the shelf element of FIG. 1 together with a reinforcing element in a perspective view.
Figure 4:
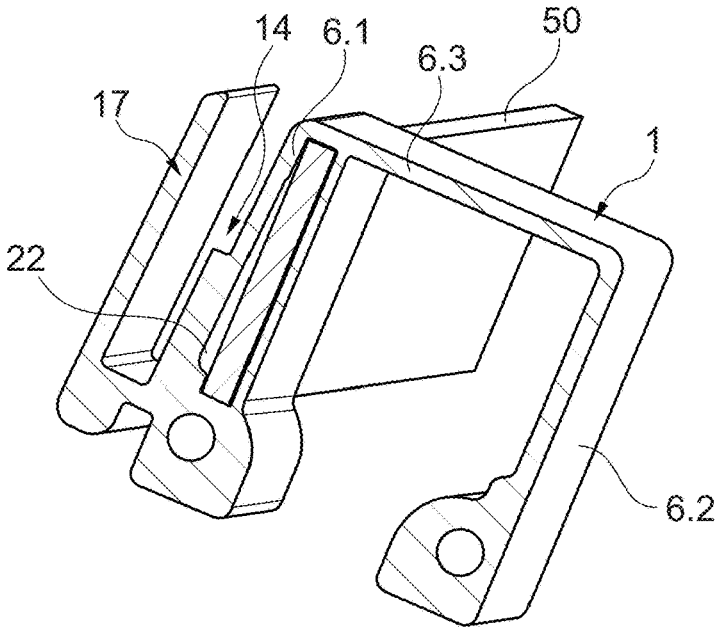
FIG. 4 shows a cut-out of the shelf element with the reinforcing element as a partial perspective section.

FIG. 3 shows the shelf element 1 in the representation in accordance with FIG. 1. FIG. 4 shows the shelf element 1 in the perspective representation in accordance with FIG. 3, wherein the shelf element 1 is shown as a cut-out over a portion in the longitudinal direction of the shelf element 1. In FIGS. 3 and 4, a separate reinforcing element 50 is assigned to the shelf element 1, in order to improve the rigidity of the shelf element 1 and thus make the shelf element 1 more robust against acting forces.

Preferably, the reinforcing element 50 is formed to reinforce the main body 6 against forces acting transversely with respect to its longitudinal extent. Preferably, the reinforcing element 50 is formed to be elongated for this purpose. For example, the reinforcing element 50 is received in the chamber structure 13 of the shelf element 1, in particular starting from one of the longitudinal-side ends 8, 9 and inserted into the chamber structure 13.

The reinforcing element 50 is, for example, a metal profile. Preferably, the reinforcing element 50 is quadrangular and/or rectangular in cross-section and extends, for example, in the direction of its longitudinal extent with a constant cross-section or essentially constant cross-section. In order to facilitate the insertion of the reinforcing element 50 into the chamber structure 13, at least one of the walls of the chamber structure 13, for example the wall portion 15 and/or the limb portion 6.1, can have an undercut 22 (FIG. 2) in order to reduce the contact area for the reinforcing element 50.

Figure 5:
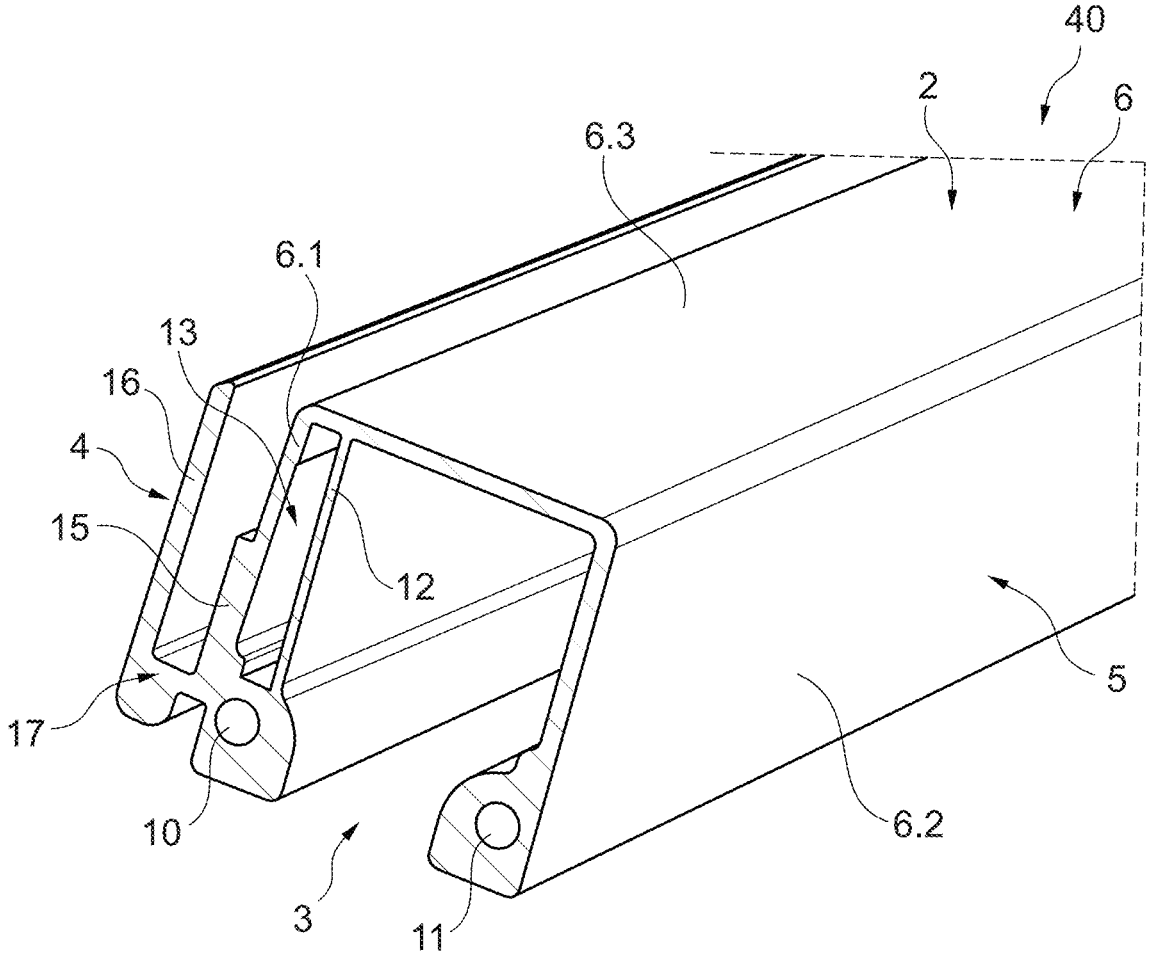
FIG. 5 shows a possible embodiment of an extruded profile for the manufacture of the shelf element of FIG. 1.

Preferably, the shelf element 1 is made of an extruded profile 40. FIG. 5 shows a possible embodiment of such an extruded profile 40. Components or functional portions of the extruded profile 40, which are identical or functionally identical to the components or functional portions of the shelf element 1 of FIGS. 1 and 2, are provided with the same reference signs; in this respect, reference is made to the description of the shelf element 1 of FIGS. 1 and 2.

The extruded profile 40 is, for example, a metal part, in particular an aluminum part. The extruded profile has the functional portions already described above with respect to the shelf element 1. The extruded profile 40 lacks the at least one through-passage opening 7 or the plurality of through-passage openings 7', which extruded profile extends transversely with respect to the longitudinal extent of the main body 6 through the intermediate portion 6.3 and/or at least one of the limb portions 6.1, 6.2. The at least one through-passage opening 7 or the plurality of through-passage openings 7' are only subsequently incorporated after the extruded profile has been produced, and in this manner the shelf profile 1 in accordance with FIGS. 1 and 2 is produced.

Figure 6:
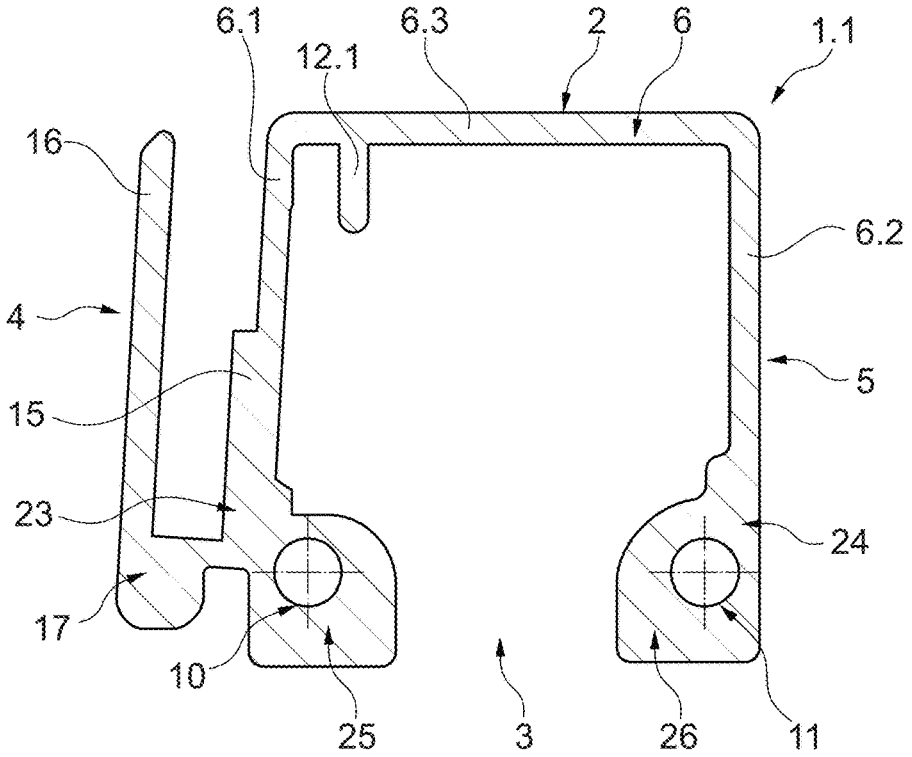
FIG. 6 shows an additional possible embodiment of a shelf element in a view of a longitudinal-side end.

FIG. 6 shows an additional possible embodiment of a shelf element 1.1. Components and functional portions of the shelf element 1.1 of FIG. 6, which are identical with components and/or functional portions of the shelf element 1 of FIGS. 1 and 2, are provided with the same reference signs; in this respect, reference is made to the description of the shelf element 1 of FIGS. 1 and 2.

The shelf element 1.1 differs from the shelf element 1 of FIGS. 1 and 2 in that a rib 12.1 is assigned to the intermediate portion 6.3, in particular is arranged thereon or is integrally formed thereon, which rib projects from the intermediate portion 6.3 towards the underside 3, without the rib 12.1 forming the chamber structure 13 of the shelf element 1 of FIGS. 1 and 2.

Figure 7:
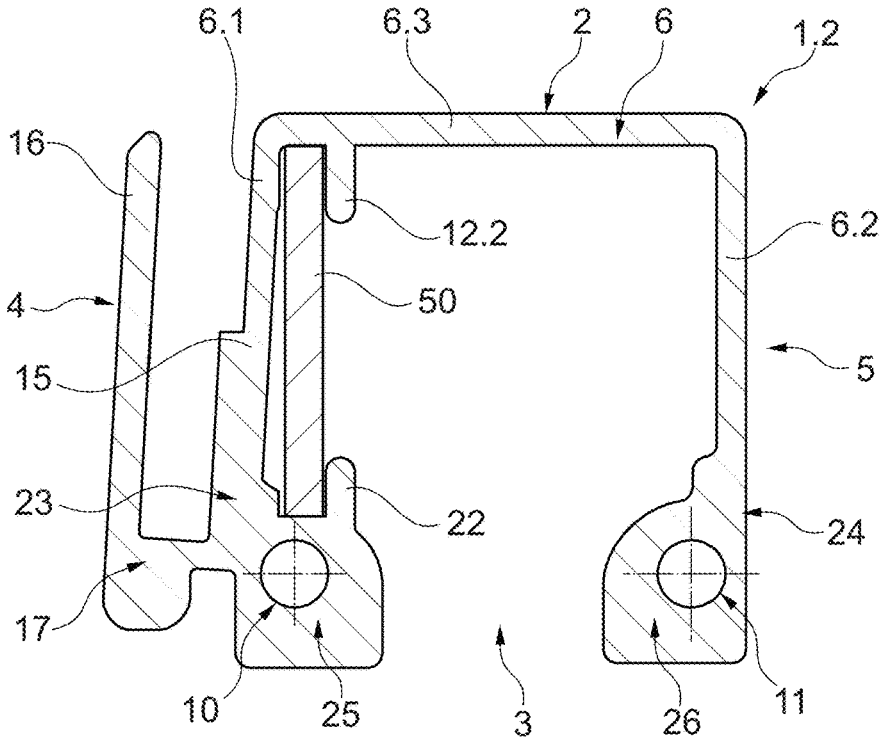
FIG. 7 shows an additional possible embodiment of a shelf element in a view of a longitudinal-side end, wherein a reinforcing element is assigned to the shelf element.

FIG. 7 shows an additional embodiment of a shelf element 1.2. Components or functional portions of the shelf element 1.2, which are identical or functionally identical to components or functional portions of the shelf element 1 of FIGS. 1 and 2, are provided with the same reference signs; in this respect, reference is made to the description of the shelf element 1 of FIGS. 1 and 2.

The shelf element 1.2 differs from the shelf element 1 of FIGS. 1 and 2 in that a rib 12.2 is assigned to the intermediate portion 6.3, in particular is arranged thereon or is integrally formed thereon, which rib protrudes from the intermediate portion 6.3 towards the underside 3. In addition, in the area of the end 23 of the limb portion 6.1 facing the underside 3, a wall portion 22 is provided which, together with the limb portion 6.1, forms a receptacle in the lower area. Preferably, the wall portion 22 and the rib 12.2 and the limb portion 6.1 form a receptacle for the reinforcing element 50, which is also shown in FIG. 2. In this respect, the wall portion 22 and the rib 12.2 together with the limb portion 6.1 form a laterally open chamber structure.

In the present description, the reference to a specific aspect or a specific embodiment or a specific configuration means that a specific feature or property that is described in connection with the respective aspect or the respective embodiment or the respective configuration, is at least contained therein is, but does not necessarily have to be, included in all aspects or embodiments or configurations. It is expressly understood that any combination of the various features and/or structures and/or properties described can be combined with one another, unless expressly or clearly contradicted by the context.

The use of any or all examples or exemplary expression in the text is intended only to illuminate the invention and does not constitute a limitation with respect to the scope of the invention, unless otherwise claimed. Nor is any expression or phrase of the description to be understood as referring to an element that is not claimed but that is essential to the practice of the invention.

LIST OF REFERENCE SIGNS

1 Shelf element
1.1 Shelf element
1.2 Shelf element
2 Upper side
3 Underside
4 Front side
5 Rear side
6 Main body
6.1 Limb portion
6.2 Limb portion
6.3 Intermediate portion
7 Through-passage opening
7' Through-passage openings
8 Longitudinal-side end

9 Longitudinal-side end
10 Coupling location
11 Coupling location
12 Rib
13 Chamber structure
14 Insertion receptacle
15 Wall portion
16 Wall portion
17 Material portion
18 Surface portion
19 Recess
20 Wall portion
21 Insertion opening
22 Wall portion
23 End
24 End
25 Material thickening
26 Material thickening
40 Extruded profile
50 Reinforcing element
E Arrow

The invention claimed is:

1. A shelf element (1) for a shelf system of a rack, comprising:

an upper side (2), an underside (3), and an elongated main body (6), wherein the main body (6), as seen in cross-section, has two limb portions (6.1, 6.2) and an intermediate portion (6.3) located therebetween, the intermediate portion (6.3) being a part of the upper side (2) of the shelf element (1), wherein the main body (6) has at least one through-passage opening (7) that passes through at least one of the limb portions (6.1, 6.2) and/or the intermediate portion (6.3) transversely with respect to a longitudinal extent of the main body (6), wherein at least one coupling location (10) is provided in each case in an area of longitudinal side ends (8, 9) of the shelf element (1), which coupling location (10) is configured to couple an add-on part and/or a shelf component and/or a rack component, wherein at least one rib (12) extends downwardly from the intermediate portion (6.3) and has a longitudinal extent in the longitudinal direction of the main body (6), wherein each of the two limb portions (6.1, 6.2) extends downwardly from the intermediate portion (6.3), wherein at least one of the two limb portions (6.1, 6.2) includes a material bulge (25) at a lower end (23) thereof, and wherein the at least one coupling location (10) comprises a longitudinally extending recess (19) formed in the material bulge (25), and wherein the at least one rib (12) extends downwardly to the material bulge (25) of an adjacent one of the two limb portions (6.1) and forms a wall portion (20) of a circumferentially closed chamber structure (13), which extends in the longitudinal direction of the main body (6).

2. The shelf element according to claim 1, wherein the at least one through-passage opening (7) passes through the intermediate portion (6.3), and wherein a surface portion (18), which can be used as an abutment, is present between the at least one through-passage opening (7) and the at least one rib (12).

3. The shelf element according to claim 1, wherein the chamber structure (13) comprises the adjacent one of the two limb portions (6.1, 6.2) as a wall portion (15).

4. The shelf element according to claim 1, wherein the chamber structure (13) is configured to serve as a receptacle for a separate reinforcing element (50).

5. The shelf element according to claim 1, wherein the shelf element (1) comprises an insertion receptacle (14) for receiving an insertion part selected from the group consisting of a price tag and a merchandise stopper, and wherein the insertion receptacle (14) is open towards the upper side (2) of the shelf element (1), in order to insert the insertion part into the insertion receptacle (14) via the upper side (2).

6. The shelf element according to claim 5, wherein, seen transversely with respect to a direction for insertion (E), the insertion receptacle (14) is formed to be elongated, in order to receive an insertion strip, selected from the group consisting of a price tag strip and a merchandise stopper strip, and wherein the insertion receptacle (14) is arranged with respect to the main body (6) such that the insertion receptacle (14) extends with its longitudinal extent in the longitudinal direction of the main body (6).

7. The shelf element according to claim 5, wherein the insertion receptacle (14) comprises at least two wall portions (15, 16), of which one wall portion (15) is formed by the main body (6) and the other wall portion (16) is formed by a material portion (17) which is integrally formed with the main body (6), and wherein an open upper portion of the insertion receptacle (14) is wider than a lower portion thereof.

8. The shelf element according to claim 5, wherein a wall portion (15) of the insertion receptacle (14) is formed by one of the limb portions (6.1, 6.2) of the main body (6), and wherein the one of the limb portions (6.1) is thinner in an area proximal to the intermediate portion (6.3) than in an area proximal to the material bulge (25).

9. The shelf element according to claim 5, wherein one of the limb portions (6.1, 6.2) of the main body (6) forms a wall portion (15) of the insertion receptacle (14) and a wall portion of the chamber structure (13).

10. The shelf element according to claim 5, wherein the limb portions (6.1, 6.2) and the intermediate portion (6.3) are arranged relative to one another such that the main body (6) has a U-shaped cross-section that is open in the direction of the underside (3) of the shelf element (1).

11. The shelf element according to claim 5, wherein, with respect to the cross-section of the shelf element (1), the main body (6) and the insertion receptacle (14) have a U-shaped wall structure with a common limb portion (6.1), wherein the U-shaped wall structure of the insertion receptacle (14) is open at a top and the U-shaped wall structure of the main body (6) is open at a bottom, and wherein the common limb portion (6.1) is used to form the chamber structure (13) comprising the rib (12).

12. The shelf element according to claim 1, wherein the shelf element (1) is made of an extruded profile (40) and is a metal part.

13. The shelf element according to claim 1, wherein a reinforcing element (50) is received in the chamber structure (13) of the shelf element (1).

14. A shelf frame for a shelf system of a rack, comprising the shelf element (1; 30) according to claim 1 as a frame part for the shelf frame.

15. A shelf system for a shelf, comprising the shelf element (1; 30) according to claim 1 and at least one deck element to support merchandise.

16. A rack, comprising at least one shelf element according to claim 1.

* * * * *